United States Patent [19]

Denholtz

[11] 4,305,511

[45] Dec. 15, 1981

[54] UTENSIL STORAGE DEVICE

[75] Inventor: Richard A. Denholtz, Westport, Conn.

[73] Assignee: Garden Way Incorporated, Charlotte, Vt.

[21] Appl. No.: 76,079

[22] Filed: Sep. 17, 1979

[51] Int. Cl.[3] ..... A47F 5/02

[52] U.S. Cl. ..... 211/70; 248/37.3

[58] Field of Search ..... 211/70, 60 R, 69, 129, 211/163, 60 T, 77, 78; 248/37.3

[56] References Cited

U.S. PATENT DOCUMENTS

| | | | |
|---|---|---|---|
| 222,107 | 11/1879 | Waters | 211/69 X |
| 2,614,698 | 10/1952 | Bell | 211/70 X |
| 2,842,260 | 7/1958 | Molitor | 211/69 X |
| 3,489,289 | 1/1970 | Scott-Fenton | 211/60 T X |

FOREIGN PATENT DOCUMENTS

| | | | |
|---|---|---|---|
| 1482838 | 4/1967 | France | 211/70 |

*Primary Examiner*—Roy D. Frazier
*Assistant Examiner*—Robert W. Gibson, Jr.
*Attorney, Agent, or Firm*—Hayes & Reinsmith

[57] ABSTRACT

A storage device for kitchen utensils, tools, artist supplies, etc. providing annular tiers of storage pockets surrounding a central hollow cylinder whose top is apertured to support bladed utensils; preferably, the main body of the storage device is a unitary molded plastic structure having spaced double walls between the storage pockets so as to provide additional storage for bladed utensils between the double walls and the entire device is supported for rotation about the central axis of the cylinder.

6 Claims, 4 Drawing Figures

UTENSIL STORAGE DEVICE

FIELD OF THE INVENTION

This invention relates to storage devices intended to eliminate the clutter and disorganization normally found in kitchen cabinet drawers, tool boxes and the like and is more particularly directed to the provision of a multi-tiered, multi-pocketed storage device of unitary construction suitable for organizing and storing a variety of implements for easy selection.

BACKGROUND OF THE INVENTION

The desire to provide for the storage and display of small articles of hardware is best represented by the early Albaugh U.S. Pat. No. 226,645 showing a plurality of tiers of small compartments in a rotary structure for the display of small nuts, bolts and the like. Other rotatable dispensing devices of the lazy susan type are shown in Ahlman U.S. Pat. No. 3,227,283 provides overlapping tiers of dish-like containers and, to obtain storage for long items such as pencils, the top tier is provided with a cover that is suitably apertured for pencils. Long narrow implements are generally stored in single purpose devices of the type shown by Lessin U.S. Pat. No. 2,446,016 directed to a special purpose knife rack.

OBJECTS OF THE INVENTION

It is therefore a principal object of the present invention to provide a compact, easily used, and portable storage device that will securely store and conveniently display a variety of kitchen implements ranging from small scissors and thermometers to long knives, which stored implements are easily accessible and removed.

It is a further object of this invention to provide a rotatable storage device having a multiplicity of easily accessible storage pockets for a variety of different sized utensils, which device is low in cost, durable, and is easily cleaned so as to permit use with food preparation implements.

It is a still further object of this invention to provide an improved storage device which is susceptible of facile use, is easily manufactured with a minimum of parts, and which is therefore very durable in use.

These and other objects will be in part obvious and in part pointed out in more detail hereinafter.

A better understanding of the objects, advantages, features and properties of the invention will be obtained from the following detailed description which sets forth certain illustrative embodiments indicative of various ways in which the principles of the invention are employed.

IN THE DRAWINGS

SUMMARY OF THE INVENTION

The preferred embodiment of the storage device of this invention is a one-piece molded plastic storage device providing two annularly disposed groups of storage pockets of different heights to accommodate different types of implements, which annular groups of pockets surround a central hollow cylinder whose closed top is apertured or slotted for storage of long utensils such as knives, the basic storage device being supported on a rotatable lazy susan type base that engages and supports the bottom of each pocket.

DESCRIPTION OF THE INVENTION

Figure 1:
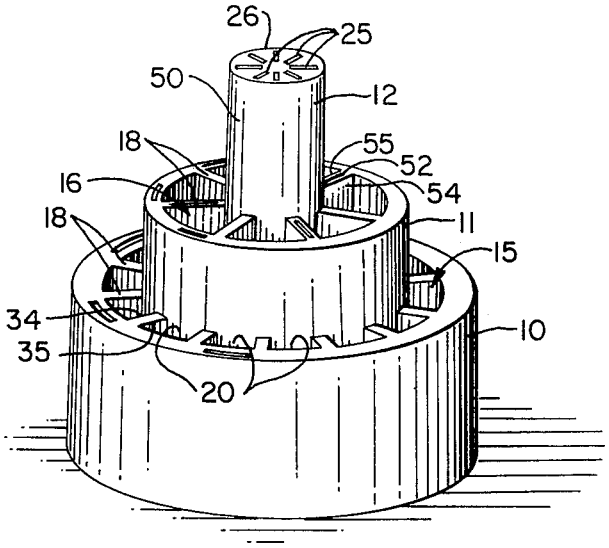
FIG. 1 is a top perspective view showing a preferred embodiment of the storage device of this invention.
Figure 3:
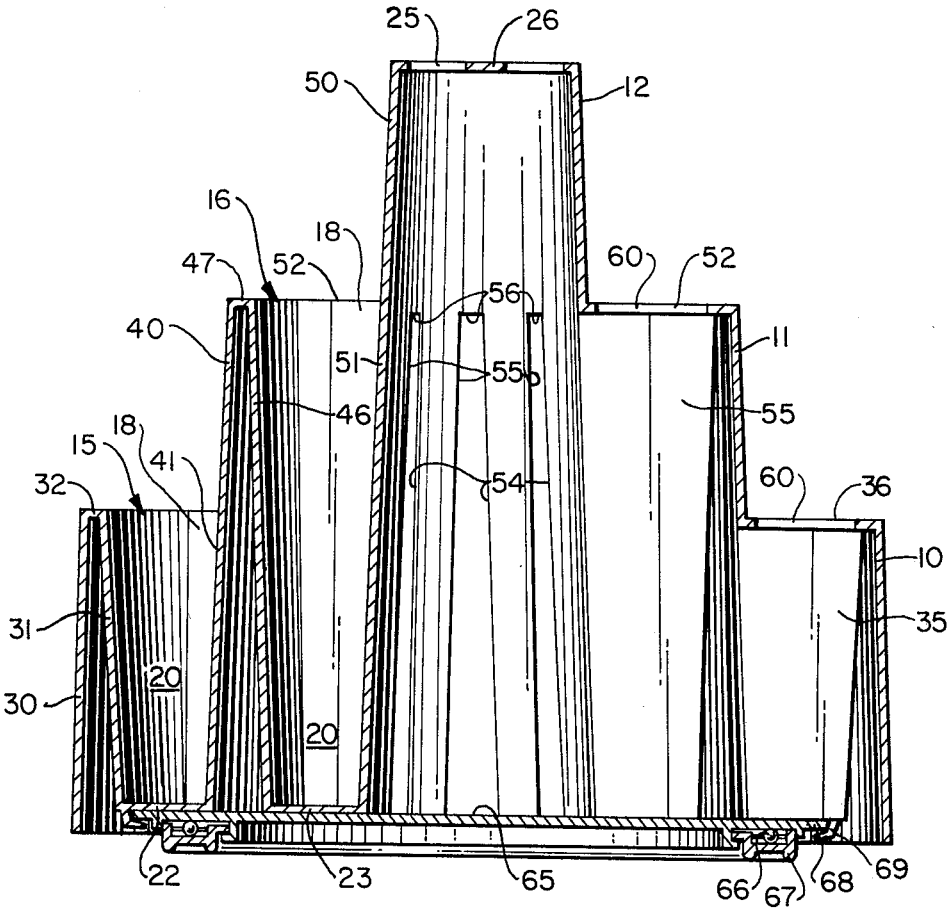
FIG. 3 is a cross section view of the storage device of FIG. 1 taken along the lines 3—3 of FIG. 2.

Turning first to FIG. 1 wherein there is illustrated a preferred embodiment of this invention, the storage device is illustrated as having the general appearance of three nested cylinders, an outer cylinder generally designated 10, a second cylinder generally designated 11, and an inner cylinder 12, the spaced sidewalls of the cylinders defining two generally annular compartments 15 and 16. Radially extending partitions 18 divide each compartment into storage pockets 20, the bottom of each pocket 20 being formed by a radially extending partitions 22 and 23 as best seen in FIG. 3. The number of annular compartments provided and the number of storage pockets formed in each annular compartment is of course a matter of choice; it has, however, been found desirable for the storage of kitchen implements to provide an outer cylinder having an outside diameter of approximately 10 inches, which size takes minimal space on a kitchen counter and is approximately the size of a standard plate. To provide adequate storage pocket depth for the storage of a variety of implements, the height of cylinder 10 is preferably 4 inches, the height of cylinder 11 is preferably 7 inches and the height of cylinder 12 is preferably 10 inches. Additionally, slots 25 are provided in top 26 of cylinder 12 to accommodate bladed utensils by inserting the blade into the slot thereby avoiding inadvertent contact with the sharp blade.

The illustrated preferred embodiment of the storage device of this invention provides the advantage of being suitable for molding in one piece from any desirable plastic material such as polypropylene, a plastic suitable for cleaning in a dishwasher; moreover, manufacture by such molding technique provides even further advantages by enabling the provision of additional storage, particularly for bladed utensils.

Figure 2:
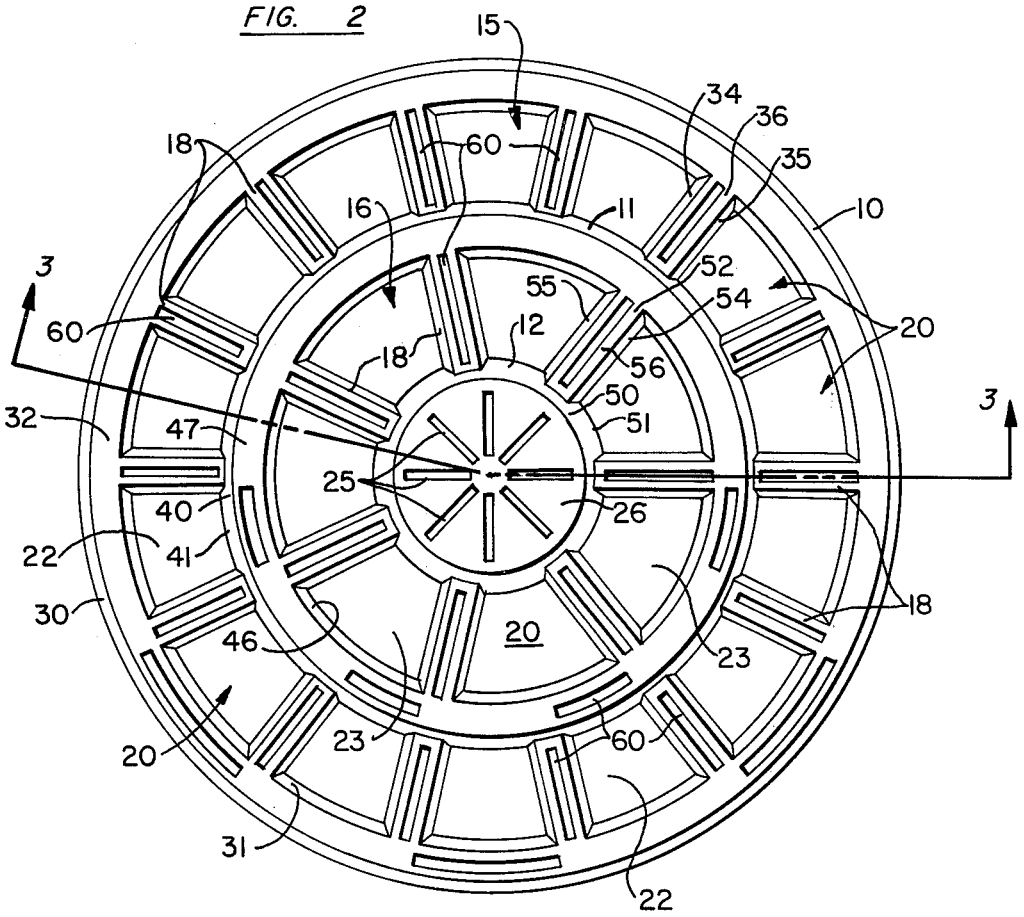
FIG. 2 is a top plan view of the storage device of FIG. 1.

The drawings, particularly FIGS. 2 and 3, show that cylinder 10 is of double walled construction, outside wall 30 of cylinder 10 being a continuous wall but inside wall 31 which is spaced from wall 30 is discontinuous, the two walls being interconnected by web 32 along their upper edge. Inner wall 31 is discontinuous at the positions where each radial partition 18 joins the inner wall, each partition being comprised of spaced walls 34 and 35 joined by web 36.

Figure 4:
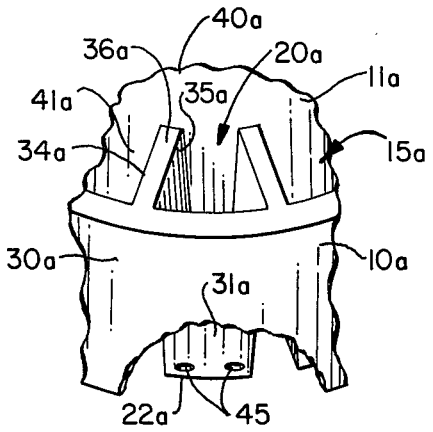
FIG. 4 is a partial perspective view of a typical storage pocket.

Cylinder 11 is provided with a continuous upper wall portion 40 and a discontinuous lower wall portion 41 the discontinuities occurring where wall portion 41 joins partition walls 34 and 35. The radially extending bottom partition 22 joins walls 34, 35, wall portion 41 and wall portion 31 to form a typical storage pocket 20 as illustrated in FIG. 4 wherein each wall and partition is identified by the same numerals of FIGS. 1–3 with the subscript letter "a". Additionally, it is shown that suitable water drain holes are provided in each pocket as at 45. Cylinder 11 is provided with a discontinuous inner wall portion 46 which is joined to the continuous wall portion 40 of cylinder 11 by web 47.

Innermost cylinder 12 is provided with a continuous upper wall portion 50 and a discontinuous lower wall portion 51. Again, each radially extending partition 52 is formed by two spaced walls 54 and 55 interconnected by web 56 along the upper edges. Thus the discontinuities of inner walls 46 of cylinder 11 and outer walls 51 of cylinder 12 occur where each is joined to the partition walls 54 and 55, the radial partition portion 23 forming the bottom and defining a storage pocket substantially identical to that shown in FIG. 4.

When viewed as a composite structure, it is seen that the storage device of this invention generally comprises hollow concentric cylinders, the outer two cylinders being partially double walled and interconnected by double wall partitions at the discontinuities of the facing inner and outer cylindrical walls, each such section being provided with a radial bottom partition so as to form a storage pocket.

By providing such a double wall construction, it is possible to provide slots in the upper webs where desired as for example, at the points identified by the numeral 60, thereby to enable additional storage of bladed utensils.

While the drawings show and the description refers to the various walls as being cylindrical, etc., it should be noted that the walls are slightly tapered as shown in the drawings so as to provide for improved molding techniques during manufacture.

It is most often desirable that the utensil storage device of this invention be rotatably supported on a kitchen counter or the like to permit the easy selection and removal of the variety of implements stored therein. A further advantage is obtained by the device of this invention by extending all storage pockets the necessary distance to make all storage pocket bottoms 22 and 23 coplanar. With such an arrangement, the storage pocket bottoms rest on disc 65, which disc forms the top of a lazy susan structure that includes an annular bearing 66 and an annular lower support 67 suitably secured together so that disc 65 can rotate relative to the support 67 about the central axis of cylinder 12. Disc 65 is provided with an upper rim extension 68 which is gripped by projections 69 formed integrally with the storage pocket bottoms. The projections 69 are, because of their plastic construction and configuration, slightly resilient and thus permit snap-in and snap-out assembly or disassembly of the lazy susan to the storage device, a feature which clearly facilitates both manufacturing as well as frequent cleaning.

It is therefore seen that the present invention provides a compact, easily used, portable implement storage device that is durable, low in cost, easily cleaned so as to provide a minimum parts for durable, long and effective life.

As will be apparent to persons skilled in the art, various modifications, adaptations and variations of the foregoing specific disclosure can be made without departing from the teachings of the present invention.

I claim:

1. A portable utensil storage device comprising a plurality of concentric generally annular juxtaposed compartments of different major diameters, each annular compartment being separated into individual smaller storage pockets by a plurality of radially directed partitions extending between the opposing sidewalls of the compartments so as to form side and bottom walls for each smaller storage pocket, the outermost annular compartment having a sidewall height providing utensil storage depth that is less than the storage depth of the next adjacent annular compartment, the innermost annular compartment being provided with an inner annular wall extending upwardly to a height greater than that of its outer wall to form a centrally located generally hollow cylinder disposed coaxially with said annular compartments, the cylinder being provided with a slotted top surface to accommodate bladed utensils extending into the hollow portion of the cylinder.

2. The storage device of claim 1 wherein the bottom wall of each of the individual storage pockets is coplanar and means is provided for supporting the device for rotation about the central axis of said cylinder.

3. The storage device of claim 1 wherein the radially extending partitions separating each individual storage pocket from the next adjacent storage pocket in the annular compartment and the circumferentially extending walls separating one annular compartment from the next adjacent annular compartment are spaced double walls interconnected by a top web.

4. The storage device of claim 3 wherein the bottom walls of each storage pocket are coplanar, and rotatable support means engaging and supporting the bottom walls of each pocket is provided.

5. The storage device of claim 4 wherein means are provided on the bottom wall of each storage pocket in the outer annular compartment to removably secure the storage device to said rotatable support.

6. The storage device of claim 3 wherein at least one of said top webs is provided with slots to accommodate bladed utensils extending into the space between the walls.

* * * * *